United States Patent [19]

Bennett

[11] Patent Number: 4,785,951

[45] Date of Patent: Nov. 22, 1988

[54] CONTAINER WITH RESEALABLE CAP

[76] Inventor: Robert Bennett, 170 Sturbridge Rd., Easton, Conn. 06425

[21] Appl. No.: 153,009

[22] Filed: Feb. 8, 1988

[51] Int. Cl.[4] ..... B65D 17/28

[52] U.S. Cl. ..... 215/32; 220/266; 222/541

[58] Field of Search ..... 215/32, 253, 250; 220/276, 266; 222/541

[56] References Cited

U.S. PATENT DOCUMENTS 4,284,199 8/1981 Bigarella ..... 215/32
4,410,096 10/1983 Paradis ..... 215/32

FOREIGN PATENT DOCUMENTS 935117 8/1963 United Kingdom ..... 215/32

*Primary Examiner*—Donald F. Norton

[57] ABSTRACT

A cap used in combination with a container having a neck with a flexible open end having a circular chamfered edge. The cap includes a first hollow member having an upper end, a vertical axis and a downwardly extending curved outer surface. The first member has a cross section which, as viewed in any horizontal plane which includes any point disposed on the vertical axis, defines a circle. The first member has a circular horizontal groove in the outer periphery of the first member adjacent its upper end. A second vertical member aligned with said axis is secured to the first member and has an upper end disposed above the first member. A lower portion of the outer curved surface of the first member is initially disposed in the opening in said neck with the groove spaced outwardly from the opening in the neck. The edge peripherally engages the first member and forms a first seal therewith. When the first seal is broken, the first member can be removed from the neck and then can be reinserted into the opening in the neck to a depth at which the edge peripherally engages the groove to form a second seal therewith.

5 Claims, 1 Drawing Sheet

FIG. 1
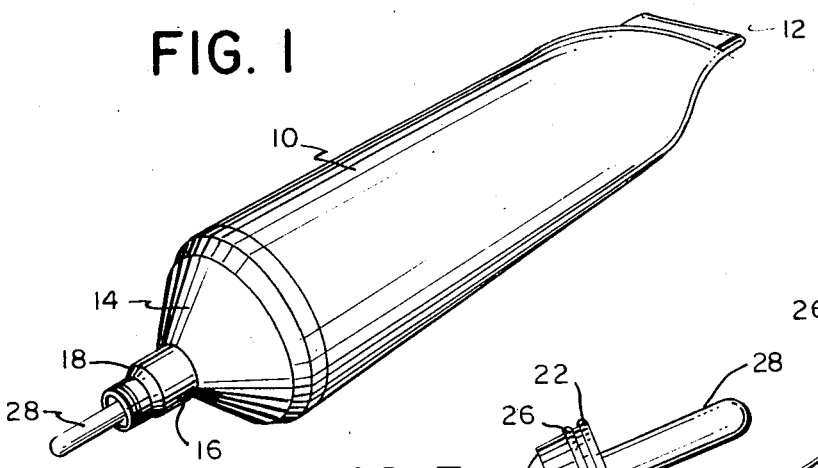
FIG. 2
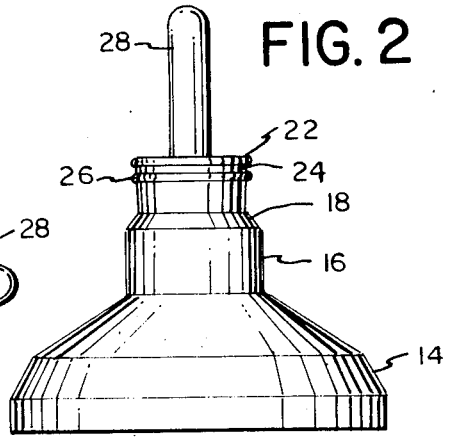
FIG. 5
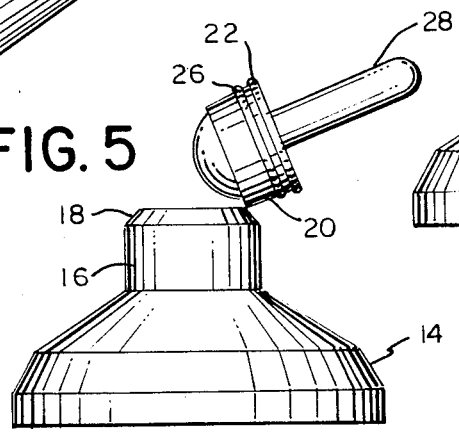
FIG. 6
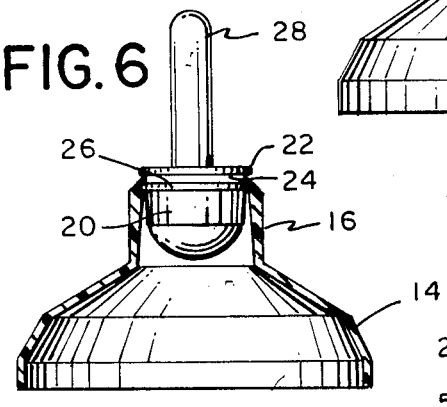
FIG. 3
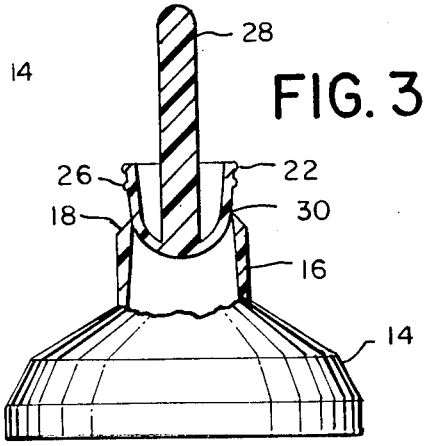
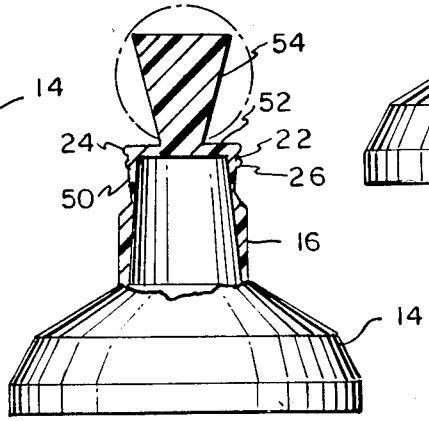
FIG. 8
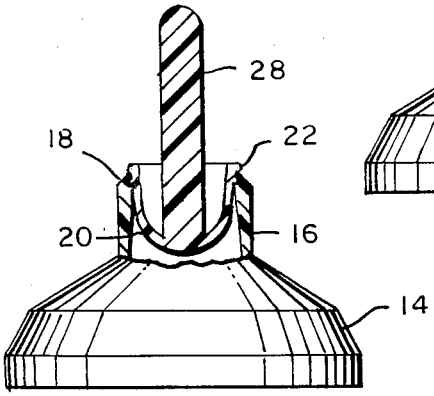
FIG. 7
FIG. 4
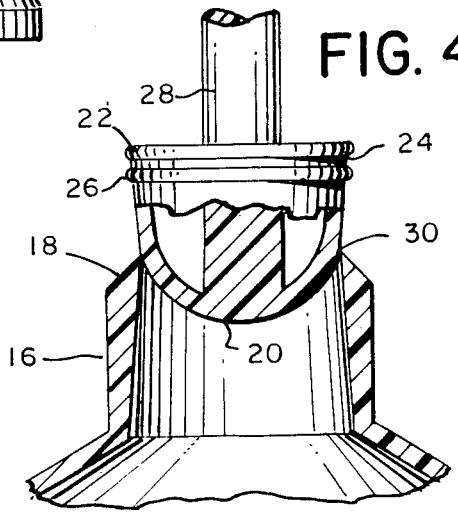

CONTAINER WITH RESEALABLE CAP

BACKGROUND OF THE INVENTION

Containers are known, for example tubes of toothpaste or the like, which have caps sealed to the containers in such manner that whenever a cap is removed, the seal is broken. However, in such known arrangements, either the cap cannot be replaced, or, if the cap is replaceable, it is not apparent from visual inspection that the seal has been broken, whereby a used tube can be sold as new, or even worse, the seal could have been broken, the contents of the tube tampered with, and the cap replaced, so that an unsuspecting user of a supposedly unopened tube could be made ill or poisoned by using contaminated contents.

The present invention overcomes these difficulties by employing a cap sealed in such a manner to the container that after the initial seal is broken the cap can be removed and replaced in such manner that it will be visually apparent to the user that the initial seal has been broken and the container resealed.

SUMMARY OF THE INVENTION

In accordance with the principles of the invention, a cap is to be used in combination with a container having a neck with a flexible open end having a circular chamfered edge. The cap includes a first hollow member having an upper end, a vertical axis and a downwardly extending curved outer surface. The first member has a cross section which, as viewed in any horizontal plane which includes any point disposed on the vertical axis, defines a circle. The first member has a circular horizontal groove in the outer periphery of the first member adjacent its upper end. A second vertical member aligned with said axis is secured to the first member and has an upper end disposed above the first member. A lower portion of the outer curved surface of the first member is initially disposed in the opening in said neck with the groove spaced outwardly from the opening in the neck. The edge peripherally engages the first member and forms a first seal therewith.

When the first seal is broken, the first member can be removed from the neck and then can be reinserted into the opening in the neck to a depth at which the edge peripherally engages the groove to form a second seal therewith. The first seal, once broken, cannot be resealed, while the second seal can be repeatedly resealed. Since the groove can only be engaged by the chamfered edge of the neck once the first seal has been broken, any user can see by inspection whether or not the container has been used.

BRIEF DESCRIPTION OF THE DRAWINGS

FIG. 1 is a perspective view of a container initially sealed with a cap in accordance with one embodiment of the invention.

FIG. 2 is a detail side view of the cap and a portion of the container shown in FIG. 1.

FIG. 3 is a cross sectional view of the structure of FIG. 2.

FIG. 4 is a view similar to FIG. 3 but showing in enlarged side view the groove and ridges used in the cap of FIG. 1.

FIG. 5 illustrates breaking of the initial seal in the structure of FIG. 1.

FIG. 6 is a partially cut away view illustrating the cap and container of FIG. 1 after the initial seal has been broken and the cap has been resealed to the container.

FIG. 7 is a cross sectional view of the cap and container neck shown in FIG. 6.

FIG. 8 illustrates a second embodiment of the invention.

DETAILED DESCRIPTION OF PREFERRED EMBODIMENTS

Referring first to FIGS. 1–7, a plastic container employs a hollow flexible tube 10 filled with toothpaste or the like and sealed at one end 12. The other end of the tube has a circular opening sealed to a tapered housing 14 having an elongated hollow neck 16 which has a chamfered circular opening 18.

A one piece plastic cap has a hollow first member 20 which has the approximate shape of the lower hemisphere of a sphere and has a vertical axis. Member 20 has an open upper end which has a horizontal circular opening. The outer periphery of the member 20 in the region of the upper end is provided with a horizontal circular groove 22. A first circular ridge 24 is secured to the outer periphery adjacent but above the groove, and a second like ridge 26 is secured to the outer periphery adjacent but below the groove.

A vertical elongated second member 28 aligned with the vertical axis is secured at its lower end to the inner surface of member 20 at its lowest point, the upper end of the member 28 extending above the open upper end of member 20.

Initially, a lower portion of member 20 is disposed in the neck and the chamfered edge is sealed thereto, forming a first breakable seal 30. To facilitate formation of the seal, the inner wall of the neck can extend upward with a slight inward incline of perhaps five degrees from the vertical.

When the tube is held in place and the member 28 is pivoted, as shown in FIG. 5, seal 30 is broken and the cap can be removed. The cap can then be reinserted in the opening in the neck and pushed downward from its initially sealed position until the chamfered edge engages the groove 22, thus forming a second seal. The cap can be repeatedly removed and resealed in this manner. Any user can visually observe the difference in position of the cap before the first seal is broken and after the second seal is employed.

FIG. 8 shows a second embodiment wherein the cap has a downwardly extending circular cylinder 50 having a closed upper end 52 and a lower open end. A flat vertical member 54 aligned with the vertical axis of the cylinder is secured at its lower end to end 52 and extends upward therefrom. The cylinder is provided with groove 22 and ridges 24 and 26 and the two seals can be formed as previously described. In order to facilitate formation of the seals, the thickness of the wall of the cylinder can taper inwardly from a maximum at the top end to a minimum at the lower end. The inner surface of the cylinder wall remains essentially vertical, so that the outer surface of the cylinder wall is tapered.

What is claimed is:

1. In combination with a container having a neck with a flexible open end having a circular chamfered edge, a cap comprising:

a first hollow member having an upper end, a vertical axis and a downwardly extending curved outer surface, said first member having a cross section which, as viewed in any horizontal plane which includes any point disposed on the vertical axis, defines a circle, said first member having a circular horizontal groove in the outer periphery of the first member adjacent its upper end; and a second vertical member aligned with said axis, the second member being secured in the first member and having an upper end disposed above the first member;

a lower portion of the outer curved surface of the first member being initially disposed in the opening in said neck with the groove spaced outwardly from the opening in the neck and said edge peripherally engaging the first member and forming a first seal therewith;

when said first seal is broken, said first member can be removed from the neck and then can be resinserted into the opening in the neck to a depth at which said edge peripherally engages said groove to form a second seal therewith.

2. The combination of claim 1 wherein the first seal, once broken, cannot be resealed, while the second seal can be repeatedly resealed.

3. The combination of claim 2 wherein the first member has first and second horizontal circular ridges secured to the outer surface thereof, the first ridge being adjacent but above the circular groove, the second ridge being adjacent but below the circular groove.

4. The combination of claim 3 wherein said first hollow member has the general shape of a lower hemisphere of a sphere.

5. The combination of claim 4 wherein the upper end of the first member is open and the second member has a lower end secured to the lowest point on the inner curved surface of the first member.

* * * * *